US005141265A

United States Patent [19]

Claar et al.

[11] Patent Number: 5,141,265

[45] Date of Patent: Aug. 25, 1992

[54] SECURING DEVICE FOR ENGINE HOODS OF MOTOR VEHICLES WITH SELF PRESENTING MANIPULATOR

[75] Inventors: Klaus-Peter Claar, Sindelfingen; Jan Schilling, Gechingen, both of Fed. Rep. of Germany

[73] Assignee: Mercedes-Benz AG, Fed. Rep. of Germany

[21] Appl. No.: 642,424

[22] Filed: Jan. 17, 1991

[30] Foreign Application Priority Data

Jan. 17, 1990 [DE] Fed. Rep. of Germany ..... 4001141

[51] Int. Cl.[5] ..... E05B 3/00; E05C 19/10

[52] U.S. Cl. ..... 292/30; 292/DIG. 14; 292/100

[58] Field of Search ..... 292/DIG. 43, DIG. 14, 292/29, 30, 28, 216, 100, 126

[56] References Cited

U.S. PATENT DOCUMENTS

| | | | |
|---|---|---|---|
| 3,207,543 | 9/1965 | Boyer | 292/DIG. 14 |
| 3,966,244 | 6/1976 | Kleisser et al. | 292/DIG. 14 |
| 4,756,562 | 7/1988 | Foster et al. | 292/28 |
| 4,961,601 | 10/1990 | Lindholm | 292/DIG. 14 |
| 4,991,884 | 2/1991 | Cairns | 292/DIG. 14 |
| 5,000,493 | 3/1991 | Bastien | 292/DIG. 14 |

FOREIGN PATENT DOCUMENTS

| | | | |
|---|---|---|---|
| 164260 | 1/1954 | Australia | 292/DIG. 14 |
| 2617623 | 12/1976 | Fed. Rep. of Germany | 292/DIG. 14 |
| 2364466 | 1/1977 | Fed. Rep. of Germany . | |
| 2854423 | 6/1980 | Fed. Rep. of Germany . | |

*Primary Examiner*—Eric K. Nicholson

*Attorney, Agent, or Firm*—Evenson, Wands, Edwards, Lenahan & McKeown

[57] ABSTRACT

The invention concerns a securing device for swivelling components of vehicles, in particular for engine hoods of motor vehicles. A securing hook which, after the release of the swivelling component, initially maintains a catch connection between this swivelling component and a fixed location mating component until the securing hook is pivoted into a release position by means of a manipulator. The manipulator, which is recessed when the swivelling component is locked, is automatically transferred into an accessible operating position by utilization of a forced advancement of the swivelling component relative to the mating component initiated by the release procedure. A control edge effectively connected to the manipulator and supported on the mating component is moved in the opening direction of the securing hook by sliding along the mating component. In order to permit an increase in the automatic manipulator advancement without doubts about safety and without sacrifices to operational comfort, the control edge is part of a control hook which is supported so that it can move relative to the securing hook and the motion of the control hook is only coupled to that of the securing hook after it is in advance of the latter.

11 Claims, 3 Drawing Sheets

SECURING DEVICE FOR ENGINE HOODS OF MOTOR VEHICLES WITH SELF PRESENTING MANIPULATOR

BACKGROUND AND SUMMARY OF THE INVENTION

The invention concerns a securing device for swivelling components of vehicles, in particular for engine hoods of motor vehicles, of the type given in the preamble to the main claim.

Such a device can be taken as already known from German Patent Document DE-PS 23 64 466, in which the manipulator is linked to the securing hook and in which the control edge is part of the securing hook. By this means, the pivoting advancement of the securing hook as far as its catch position (caused by the control edge) and the advancement displacement of the manipulator between its position recessed into a radiator grille and its operating position protruding out of the radiator grille are in a direct relationship. If the advancement displacement of the manipulator should be increased, e.g. so that a more easily gripped manipulator can be used, the securing hook itself must also be increased by a corresponding amount.

The securing hook must, however, be reliably able to fulfill its catch function even in driving operation when the lock of the engine hood is accidentally released and the engine hood moves rapidly upwards, supported by the dynamic pressure of the wind relative to the vehicle.

An increased mass of the resulting securing hook swinging towards the front would then have to be compensated by a correspondingly strong return spring, which again would have disadvantageous effects on the manipulator operating forces.

Also known from German Patent Document DE-OS 28 54 423 is a grip arrangement for a swivelling component of vehicles in which a manipulator is swivelled from a recessed at-rest position into a release position suitable for operation as soon as a locking of the swivelling component has been canceled. For this purpose, a control hook is provided which is supported so that it can swivel; this control hook is located on the swivelling component and is moved in the opening direction by sliding along the mating component. By this means, it controls a stored spring-energy drive for the manipulator and a securing element for an end position of the manipulator.

However, the known arrangement does not include a securing hook which, after the release of the swivelling component, must initially maintain a catch connection between the latter and the corresponding mating component. In consequence, the problems associated with unintended cancellation of such a catch connection because of a design increase in the manipulator advancement do not appear at all.

In addition, the control of the known grip arrangement is extremely complicated so that it could hardly be used in the case of a securing hook because of the installation space required, as is already known from German Patent Document DE-PS 23 64 466.

An object of the invention is, therefore, to further develop a securing device of the generic type in such a way that, while retaining its compact construction, an increase in the automatic manipulator advancement is possible without doubts about safety and without sacrifices in the operating comfort of the securing device.

This object is achieved in the invention by an arrangement wherein the control edge is part of a control hook which is supported so that it can swivel with motion relative to the securing hook near the latter and in an approximately parallel plane, a drive feature protruding from one of the control hook and securing hook and penetrating transverse to the plane of swivelling of the corresponding other one of the control hook and securing hook, by means of which drive feature the motion of the control hook is coupled to that of the securing hook only after it is in advance of the latter.

Because the control hook is formed separately from the securing hook, the control edge can be designed to produce the largest possible advancement of the manipulator without having to take account of the hook shape. On the other hand, the securing hook can also be optimized with respect to strength because the way it is shaped no longer has any effect on the curve of the control edge. Because the swivelling planes of the control hook and the securing hook are located in adjacent mutually parallel planes, the particularly simple coupling of the motion of the two hooks by means of a rigid drive feature is ensured, the advance of the control hook relative to the securing hook being fixed by the arrangement of the drive feature.

The amount of control hook advance is preferably selected in such a way that the motion of the control hook is only coupled with that of the securing hook in the operating position of the manipulator. In consequence, the securing hook does not take part in the automatic forward-swinging movement of the control hook; it retains its catch position unaltered.

A particularly simple way of coupling the motion of the control hook with that of the securing hook can be achieved by means of a rigid drive feature protruding from one of the two interacting components, provided the pivoting planes of the control hook and the securing hook are located in adjacent and mutually parallel planes.

In order to achieve a simple construction of the device, the securing hook and the control hook can be supported on a common hinge pin. For manufacturing reasons, it is desirable to shape the drive feature on the control hook according to especially preferred embodiments.

In the case of a plate-shaped control hook, the drive feature preferably consists of a plate stop which protrudes at right angles from one wide side of the control hook and makes contact as an area with a rear edge of the securing hook. Because of the area contact of the plate stop on the rear edge of the securing hook, the demands made on the bending stiffness of the plate stop are reduced to a minimum.

An extension of the plate stop by a hook-shaped guide strap at an angle can then ensure that the plate stop cannot slip from the rear edge of the securing hook because, for example, of its own bending. In addition, the demands made on the bearing precision of the control hook can be substantially reduced as a result.

In the interest of the greatest possible functional reliability, it is advantageous for both the control hook and the securing hook to be loaded by means of their own return springs. In the case of one of the return springs fracturing, a return force can, by this means, be transmitted to both components by the functioning return spring if, in addition to the plate stop, a further drive stop is provided which acts in the reverse swivelling direction.

With the limitation of an unintentional and erroneous release of the hood lock while travelling, the securing device remains functional even without any spring-loading on the control hook or the securing hook if both the securing hook and the control hook have a corresponding return lug.

A control hook consisting of plastic can be manufactured at favorable cost by an injection molding method, for example, and such a hook is characterized by the fact that its own weight is relatively low.

The resulting low acceleration mass of the control hook, relative to metallic materials, contributes to a further increase in the safety reserves of the device.

In addition, the return spring associated with the control hook can be dimensioned to be weaker, which contributes to the operating comfort when pulling the manipulator.

Other objects, advantages and novel features of the present invention will become apparent from the following detailed description of the invention when considered in conjunction with the accompanying drawings.

DETAILED DESCRIPTION OF THE DRAWINGS

Figure 1:
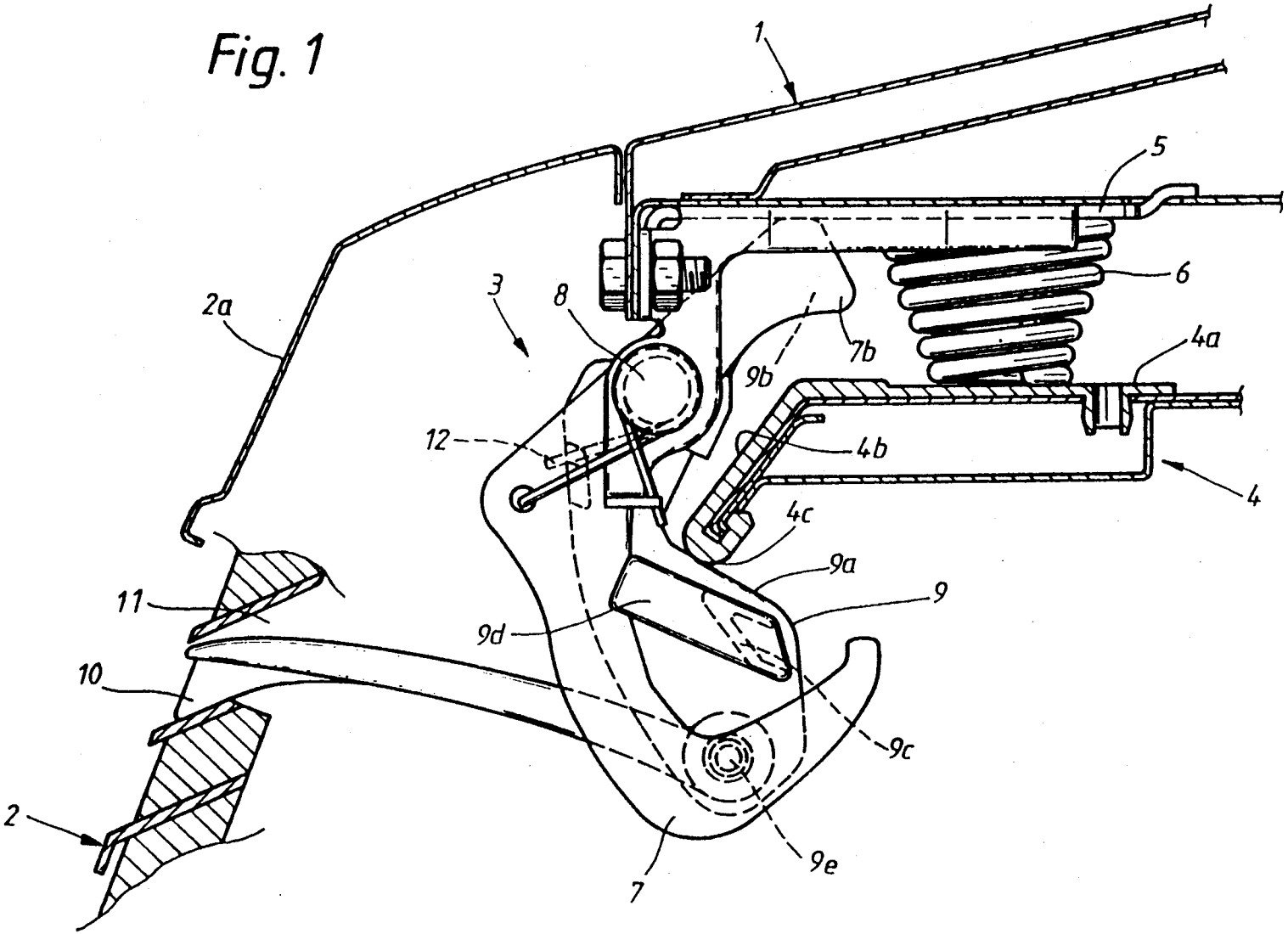
FIG. 1 shows a side view of a securing device in its installed position in a closed engine hood of a motor vehicle, constructed according to a preferred embodiment of the invention.

FIG. 1 shows a longitudinal section through the front of a motor vehicle in the transition region from an engine hood 1 to a radiator grille 2, the radiator grille 2 being supported by a radiator cover 2*a* which is permanently connected to the engine hood 1 and follows on from the front edge of the latter. The structural unit consisting of the engine hood 1 and the radiator grille 2 is fastened (in a manner not shown) along a rear edge of the engine hood 1 by hinge arms to the body of the motor vehicle, by which means it can be pivoted up towards the rear about a horizontal transverse axis of the vehicle.

It is shown, however, in a closed position in which it is held by means of one or more catches (which cannot be seen), i.e. it is locked to the body of the motor vehicle.

In addition to these catches which can be released from the passenger compartment of the motor vehicle by means of remote control, there is a securing device 3 located in the center of the engine hood 1 under its front end region and this device interacts with a radiator bridge-piece 4 extending above a radiator and permanently fixed to the body.

For this purpose, the securing device 3 includes, as main components, a carrier plate 5 which is bolted to the underside of the engine hood 1 opposite to the radiator bridge-piece 4, a compression coil spring 6 whose winding upper end is fastened with axial support to the underside of the carrier plate 5, a securing hook 7 which is hinged to the carrier plate 5 by means of a hinge pin 8, a control hook 9 which is supported on the hinge pin 8 to the side of and near the securing hook 7 and a rod-shaped pull-grip 10, whose rear end is hinged on the control hook 9 and whose front end region is guided so that it can slide in an opening 11 through the radiator grille 2.

The compression coil spring 6 is axially compressed and is supported at its lower end, with corresponding preload, on a horizontal support surface 4*a*. This support surface 4*a* of the radiator bridge-piece 4 consisting of a hollow box section merges into a guard surface 4*b* at a distance in front of the compression coil spring 6, this surface 4*b* being located in a plane directed obliquely downwards and to the front. The guard surface 4*b* ends in a hooked-in edge 4*c* protruding downwards, the rounded lower edge of this hooked-in edge interacting as engagement edge with the control hook 9 and the securing hook 7.

In contact with the lower edge of the hooked-in edge 4*c*, there is a straight control edge 9*a* which extends in the longitudinal region of the rear edge of the plate-shaped control component 9. In this arrangement, the major part of the longitudinal extension of the control edge 9*a*, which is inclined towards the rear approximately at right angles to the guard surface 4*b*, is located behind the hooked-in edge 4*c* and subsequently becomes an almost vertically falling terminating edge.

The control hook 9 extends upwards at a distance in front of the guard surface 4*b*, and it is there supported approximately at the level of the support surface 4*a* on the hinge pin 8 which penetrates transversely through the control hook 9. Above the hinge pin 8, the control hook 9 is extended by a lever arm whose end edge is in contact with the bottom of the carrier plate 5. The control hook 9 is held in its initial position shown by the support given to its lever arm because it is swivel-loaded in the anti-clockwise direction by means of a leg spring 12 whose two spring legs are supported by means of support features on the control hook 9, on the one hand, and on the carrier plate 5, on the other.

In addition, a return lug 9*b* protrudes downwards from the end region of the lever arm and this return lug is vertically located approximately half way between the support surface 4*a* and the bottom of the carrier plate 5.

On the wide side of the plastic material control hook 9 facing towards the observer, a plate stop 9*c* is injection molded approximately in the center of and under the control edge 9*a*; this plate stop 9*c* merges into a guide strap 9*d*. The plate stop 9*c* extends away from the control hook 9 in a plane transverse to the latter before it is continued by the guide strap 9*d*. The latter extends forward parallel to the opposite wide side of the control hook 9. In this arrangement, viewed over its stop length, the plate stop 9*c* extends obliquely downwards towards the rear.

The length of the guide strap 9*d* is dimensioned in such a way that its free end overlaps a wide side of the securing hook 7, which is supported so that it can swivel in a plane located between the control hook 9 and the guide strap 9*d*.

On the wide side remote from the securing hook 7, a stub pin 9*e* is injection molded onto the control hook 9 and the rear end of the pull-grip 10 is supported on this stub pin.

The securing hook 7, hinged on the hinge pin 8 independently of the control hook 9, is fixed in its initial position shown by means of a leg spring 13. The spring legs of the leg spring 13 are respectively supported on an associated support feature of the securing hook 7 and of the carrier plate 5, the securing hook 7 being swivel-loaded in the anti-clockwise direction. The swivelling support of the securing hook 7 takes place in a similar manner to that of the control hook 9 by means of a lever arm protruding above the hinge pin 8 and provided with a return lug 7*b*, which lever arm is located at the side of and near the lever arm of the control hook 9 and has a coincident peripheral contour. Beneath the hinge pin 8, the rear edge of the securing hook 7 extends, at a distance from the guard surface 4*b*, approximately vertically initially and then continues in a straight length region inclined slightly obliquely towards the rear, reaches its deepest extent vertically below hooked-in edge 4*c* and then runs on obliquely upwards and to the rear, after which it ends in a short edge section which is again directed vertically upwards. The free end of the securing hook 7 provided with the short edge section is located so that it overlaps the plate stop 9*c* in height and is at a distance behind the latter.

Figures 2, 3:
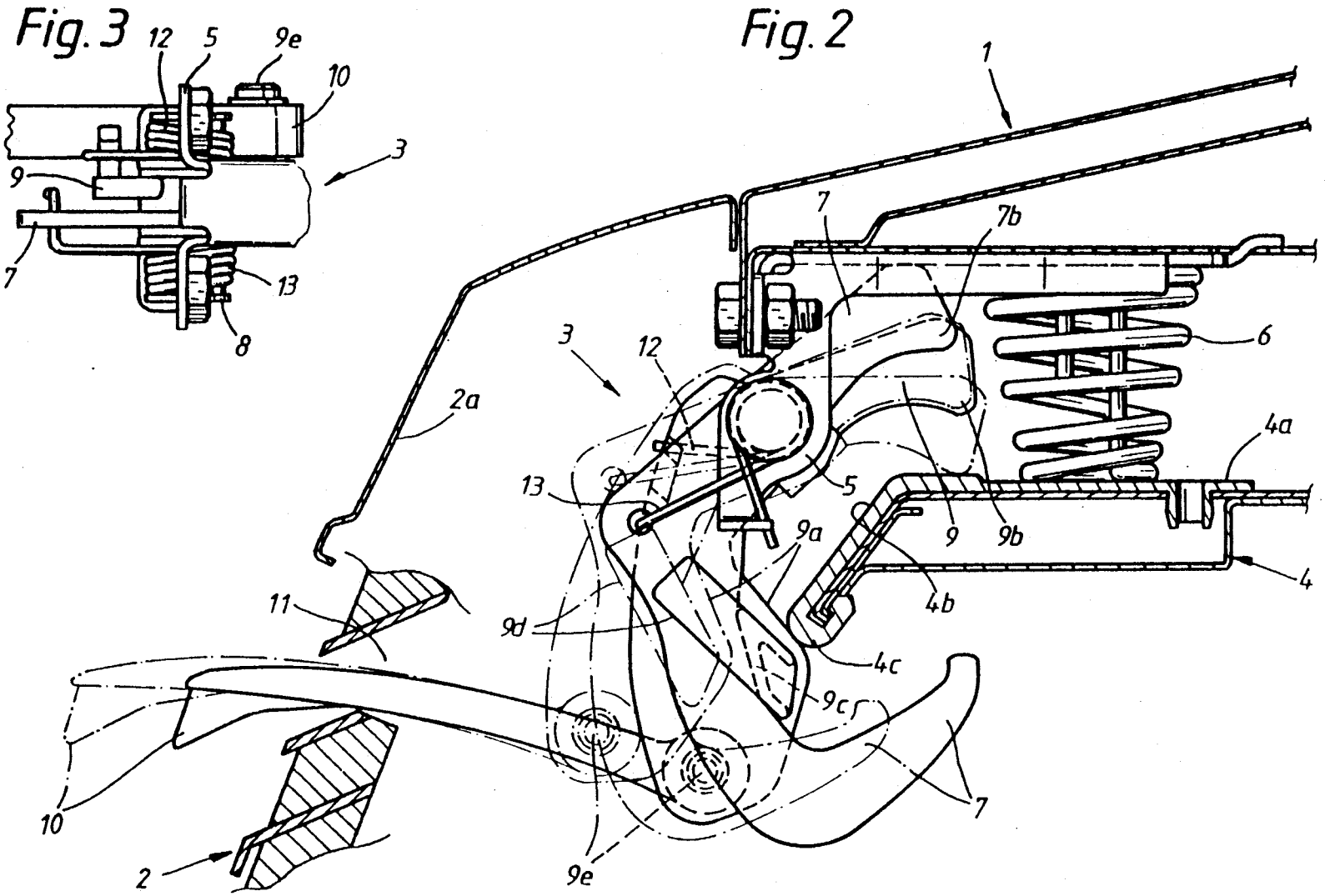
FIG. 2 shows the arrangement of FIG. 1 with the engine hood released.
FIG. 3 shows a plan view on a front region of the securing device.

On the basis of the construction described of the securing device 3 of FIG. 1, in associated with the partial plan view of FIG. 3, the following functional procedure takes place in the case of normal operation:

After the hood lock is released, the compression coil spring 6 acts as a stored spring-energy drive, i.e. the released compression coil spring 6 expands and presses the engine hood 1 upwards. Corresponding to the spring release displacement, the engine hood 1 is raised into a position which can be seen in FIG. 2, the securing device 3 having taken part in the motion of the engine hood 1 relative to the radiator bridge-piece 4. Because of this, the lower edge of the hooked-in edge 4*c* slides downwards along the control edge 9*a* so that the control hook 9 is swivelled in the clockwise direction against its spring load. The spring release displacement of the compression coil spring 6 is matched to the length of the control edge 9*a* in such a way that the lower edge of the hooked-in edge 4*c* is subsequently in contact with the control edge 9*a* near the lower terminating edge of the control hook 9. In addition, the angle of inclination of the control edge 9*a* is dimensioned in such a way that the plate stop 9*c* makes contact as an area with the rear edge of the securing hook 7 after the swivelling motion of the control hook 9 has been concluded. Because the pull-grip 10 is hinged on the stub pin 9*e*, the pull-grip 10 is pushed out sufficiently far from the opening 11 in the course of this advancement for it to be comfortably gripped by the hand of the operator. Because the securing hook 7 has retained its catch position unaltered during these procedures, the engine hood 1 cannot be completely opened without further action.

Only after the pull-grip 10 is subsequently pulled out into its opening position indicated by chain-dotted lines is the securing hook 7 taken along by the control hook 9 via the plate stop 9*c* and swivelled forward into its release position against its spring load. The withdrawal motion of the pull-grip 10 is then limited by the fact that the return lug 9*b* comes into contact with the support surface 4*a*.

In the release position shown of the securing hook 7, its front end can therefore swing upwards past the hooked-in edge 4*c* because the engine hood 1 is guided on parallelogram-type links by means of which the pivoting motion of the engine hood 1 has superimposed on it, in known manner, a feed motion of the engine hood 1 in the longitudinal direction of the vehicle. After the release of the pull-grip 10 when the engine hood 1 is open, the securing hook 7 and the control hook 9 swing back automatically, under their spring loads, into their initial position as shown in FIG. 1. When the engine hood 1 is subsequently pressed home, the lower edge of the free end of the securing hook 7 runs up on the guard surface 4*b* so that it is swivelled into its release position. After the engine hood 1 has been completely closed, the securing hook 7 and the control hook 9 automatically resume their initial position in which they pass under the hooked-in edge 4*c*, ready to catch it. Because both the securing hook 7 and the control hook 9 have their own return lugs 7*b* and 9*b*, respectively, a forced return position is achieved in the case of the hooks 7 or 9 jamming in the release position or in the case of failure of the return because of a spring fracture. This is because the return lugs 7*b* and 9*b* come into contact with the support surface 4a when the engine hood 1 is pressed home so that they are automatically swivelled in the direction of their securing advancement.

Figure 1A:
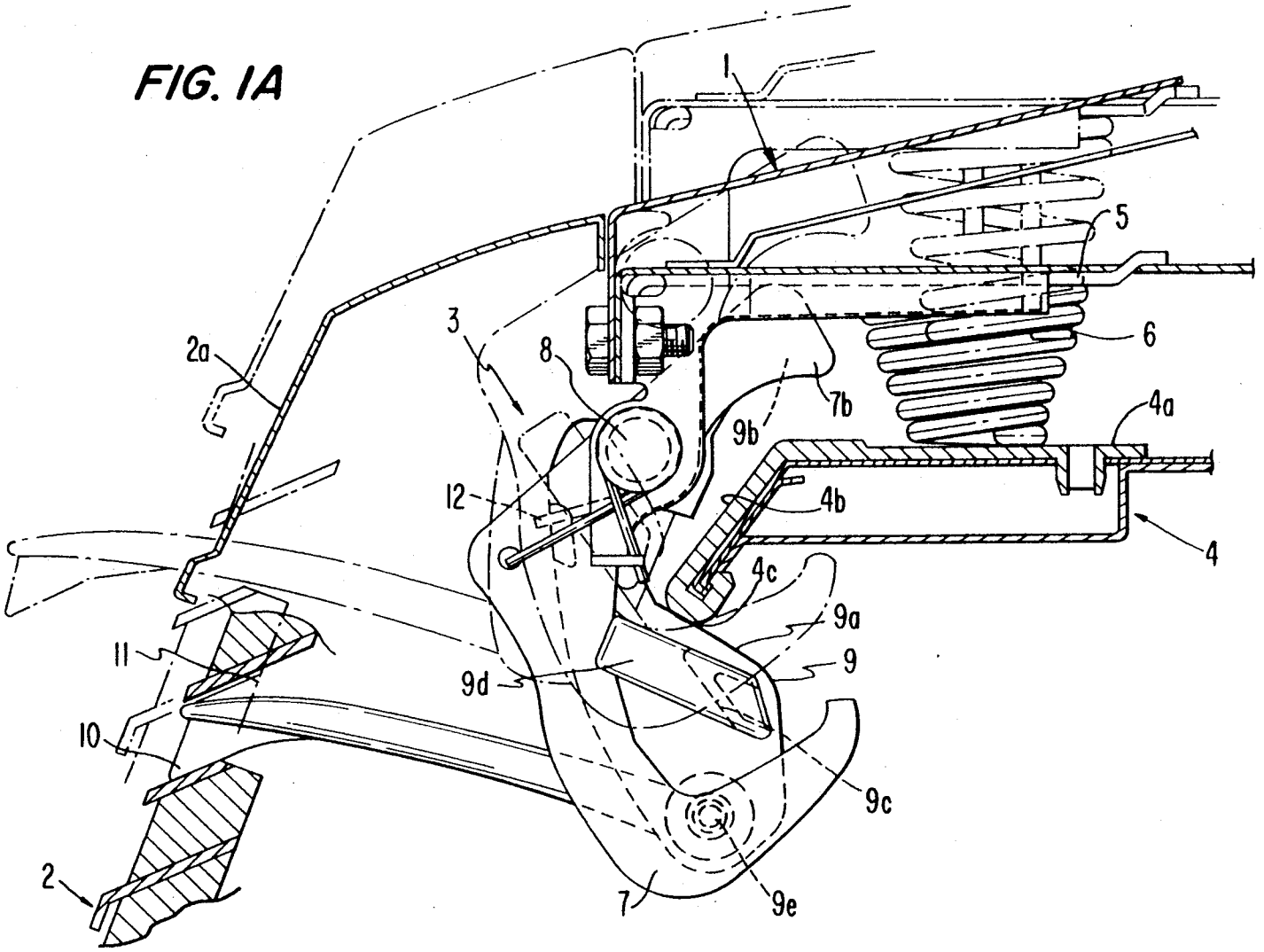
FIG. 1A is a view of the arrangement of FIG. 1 showing the catch position of the securing hook in interrupted lines.

FIG. 1A illustrates the catch position of the securing hook by means of interrupted lines. This shows that the securing hook 7 with respect to its position when the engine hood is closed has carried out only a minimal swivelling motion about the hinge pin 8. In contrast, the control hook 9, because its control edge 9*a* slides along the hook-in edge 4*c* of the radiator bridge piece 4, has carried out a considerable swivel motion about the hinge pin 8 by which the pull grip 10, which is hinged directedly to the control hook 9, is pushed out of the passage opening 11 into its operating position. The securing hook 7 and the control hook 9 can therefore be swivelled in the same direction in which case, when the engine hood 1 is closed, the control hook 9 reaches underneath the hook-in edge 4*c*, and when the engine hood is correspondingly lifted up, the securing hook 7 reaches underneath the hook-in edge 4*c*.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Securing device for securing a vehicle hood at a vehicle fixed part, said securing device comprising:

a securing hook member which is engageable with a vehicle fixed part to secure the hood against excess inadvertent opening movement when the hood is released so as to move from a closed position to a partial opened position, a manipulator which automatically moves from an inexcessible recessed position to an excessible manually engageable position outside a hood compartment in response to movement of the hood from the closed position to the partial opened position, and a control member which is pivotable about a vehicle transverse axis, said control member including a control edge which slidably engages the fixed part to be forcibly pivoted thereby, said control member being hingeably connected to the manipulator so as to move the manipulator axially of the vehicle to its accessible position in response to forced pivotal movement of the control member by way of engagement of the control edge and fixed part.

2. Securing device according to claim 1, wherein the motion of the control member is coupled to that of the securing hook in the operating position of the manipulator.

3. Securing device according to claim 1, wherein the securing hook and the control member are hinged on a common axis.

4. Securing device according to claim 1, wherein the control edge is formed integrally on the control member.

5. Securing device according to claim 2, wherein a plate stop which makes contact as an area with a rear edge of the securing hook is provided as the control edge.

6. Securing device according to claim 4, wherein a plate stop which makes contact as an area with a rear edge of the securing hook is provided as the control edge.

7. Securing device according to claim 5, wherein the plate stop is extended by a guide strap angled approximately parallel to the plane of oscillation of the securing hook.

8. Securing device according to claim 6, wherein the plate stop is extended by a guide strap angled approximately parallel to the plane of oscillation of the securing hook.

9. Securing device according to claim 1, wherein the securing hook and the control member are spring-loaded independently of one another in the direction of their securing advancement.

10. Securing device according to claim 2, wherein the securing hook and the control member each have a return lug which, in the course of the closing procedure of the hood and in the case of a failure of the associated spring, carries out the securing advancement of the securing hook, and control member by making contact with a surface of the mating component.

11. Securing device according to claim 1, wherein the control member consists of plastic.

* * * * *